US007871324B2

(12) United States Patent
Kaminkow

(10) Patent No.: US 7,871,324 B2
(45) **Date of Patent: *Jan. 18, 2011**

(54) GAMING DEVICE HAVING A COUNTDOWN INDICATOR ASSOCIATED WITH AN AWARD INDICATOR

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 1124 days.

This patent is subject to a terminal disclaimer.

(21) Appl. No.: 10/899,165

(22) Filed: Jul. 26, 2004

(65) Prior Publication Data

US 2004/0266512 A1 Dec. 30, 2004

Related U.S. Application Data

(62) Division of application No. 09/629,235, filed on Jul. 31, 2000, now Pat. No. 6,780,105.

(51) Int. Cl.
*A63F 9/00* (2006.01)

(52) U.S. Cl. ..... 463/16

(58) Field of Classification Search ..... 463/16–20, 463/23, 30, 31

See application file for complete search history.

(56) References Cited

U.S. PATENT DOCUMENTS 4,621,814 A 11/1986 Stepan et al.
5,188,363 A * 2/1993 Marnell et al. ..... 463/13
5,342,047 A 8/1994 Heidel et al.
5,449,173 A 9/1995 Thomas et al.
5,560,603 A 10/1996 Seelig et al.
D392,340 S 3/1998 DeSimone
5,766,074 A 6/1998 Cannon et al.
5,772,509 A 6/1998 Weiss (Continued)

FOREIGN PATENT DOCUMENTS

EP 0874337 A1 10/1998

(Continued)

OTHER PUBLICATIONS

AtariAge. X-Man Game Manual—Atari 2600—Universal Gamex. Released 1983. Date accessed Apr. 19, 2009.*

(Continued)

*Primary Examiner*—Joe H. Cheng
*Assistant Examiner*—Andrew Kim
(74) *Attorney, Agent, or Firm*—K&L Gates LLP

(57) ABSTRACT

A gaming device including a video display containing multiple or split screens displayed at one time. Each of the screens displays indicia relating to a single event and thus each of the screens preferably displays indicia relating to the other screens of the display. The screens preferably present the event a chronological or otherwise sequential manner. The screens can show different views of the event occurring at one time of the event and can show the same view of different times of the event in one display. At some point, in accordance with the event or theme of the bonus round, the game provides an award to the player in such a way that is exciting to the player. The game can employ one or more of the screens in awarding the player, wherein one or more screens displays the award, and wherein other screens celebrate the award.

46 Claims, 11 Drawing Sheets

U.S. PATENT DOCUMENTS

| | | | | |
|---|---|---|---|---|
| 5,807,172 | A | | 9/1998 | Piechowiak |
| 5,911,418 | A | | 6/1999 | Adams |
| 5,967,894 | A | * | 10/1999 | Kinoshita et al. ..... 463/13 |
| 5,976,016 | A | | 11/1999 | Moody et al. |
| 6,089,978 | A | | 7/2000 | Adams |
| 6,126,165 | A | | 10/2000 | Sakamoto |
| 6,135,884 | A | | 10/2000 | Hedrick et al. |
| 6,176,781 | B1 | | 1/2001 | Walker et al. |
| 6,254,481 | B1 | | 7/2001 | Jaffe |
| 6,287,197 | B1 | | 9/2001 | Dickinson et al. |
| 6,899,625 | B2 | | 5/2005 | Luciano, Jr. et al. |

FOREIGN PATENT DOCUMENTS

| | | |
|---|---|---|
| EP | 0945837 A2 | 9/1999 |
| EP | 0984409 A2 | 3/2000 |
| WO | WO 9732285 | 9/1997 |
| WO | WO 0012186 | 3/2000 |

OTHER PUBLICATIONS

Jackpot Party Brochures & Articles, WMS Gaming, Inc., 1998.
Dual Screen Keno Machine Picture, available prior to Jul. 31, 2000.
Cast for Cash Brochure and Website, WMS Gaming, Inc.
Picture in Picture Description, available prior to Jul. 31, 2000.

* cited by examiner

FIG. 5

64

| | NO. OF VIEWS DISPLAYED | TIME OF THE EVENT | NUMBER OF SCREENS EMPLOYED |
|---|---|---|---|
| 66 | Same View | Same Time | Different Screens |
| 68 | Same View | Different Times | Same Screen |
| 70 | Same View | Different Times | Different Screens |
| 72 | Different View | Same Time | Same Screen |
| 74 | Different View | Same Time | Different Screens |
| 76 | Different View | Different Times | Different Screens |
| 78 | Different View | Different Times | Same Screen |

GAMING DEVICE HAVING A COUNTDOWN INDICATOR ASSOCIATED WITH AN AWARD INDICATOR

PRIORITY CLAIM

This application is a divisional of U.S. patent application Ser. No. 09/629,235, filed on Jul. 31, 2000, now U.S. Pat. No. 6,780,105 B1, the entire contents of which are incorporated herein.

CROSS-REFERENCE TO RELATED APPLICATIONS

This application is related to the following commonly-owned patent applications: "GAMING DEVICE HAVING BONUS SCHEME WITH INCREMENTAL VALUE DISCLOSURE," Ser. No. 09/627,198, now U.S. Pat. No. 6,582,306, "GAMING DEVICE HAVING INCREMENTAL VALUE DISCLOSURE," Ser. No. 10/447,779, and "GAMING DEVICE HAVING A GAME WITH INCREMENTAL VALUE DISCLOSURE AND VALUE MODIFICATION," Ser. No. 10/661,209.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device including a countdown indicator associated with an award generator.

BACKGROUND OF THE INVENTION

Gaming machines currently exist with bonus rounds in which a player has one or more opportunities to choose bonus awards that are initially masked from a group of symbols arranged in a pattern displayed to the player. When the player chooses a masked symbol from the pattern, the game removes the mask and either reveals (or awards) the player with a bonus value or reveals a bonus terminator which terminates the bonus round. The outcome depends upon whether the player picks an award or terminator. The controller of the gaming machine randomly places a predetermined number of bonus awards and bonus terminators in the pattern at the beginning of the bonus round and maintains the positioning until the bonus round terminates.

When the player picks a symbol that awards a bonus value, the player receives bonus credits and the bonus round typically displays a message that the player may continue and enables the player to pick another symbol. The player then picks another masked symbol, and the process continues until the player picks a bonus round terminator. European Patent Application No. EP 0 945 837 A2 filed on Mar. 18, 1999 and assigned on its face to WMS Gaming, Inc. discloses a bonus round of this type.

To increase player enjoyment and excitement, it is desirable to provide players with new bonus rounds wherein the players have opportunities to receive one or more awards. In particular, it is desirable to provide players with opportunities to receive valuable awards and display the awards in a manner that provides entertainment and enjoyment to the player. It is also desirable to present a theme while displaying the awards, with which the player is familiar, and which provides entertainment and enjoyment to the player.

SUMMARY OF THE INVENTION

The present invention includes a bonus round wherein a video monitor contains multiple or split screens displayed simultaneously. The game is adapted to display a different number of screens at different points or times during the bonus round. Each of the screens can display the same or different video or images as the other screens. The screens can display static, animated, computer generated and/or motion picture images. Each of the screens preferably displays images relating to a single event or theme employed by the game, and thus each of the screens preferably displays indicia relating to the other screens of the display. The present invention preferably provides suitable audio sounds, voices and music that correspond to and enhance the event or theme and the player's level of excitement.

The screens preferably present the event or theme in a chronological or otherwise sequential manner. The screens can also show different views or images of the event or theme occurring at one time of the event or theme. Different screens can display separate views, images or actions within the theme or event and, alternatively, the different screens can also display the same view, image or actions to emphasize such displays. Certain screens can contain or display no views or images or blank views or images of the theme, so that the game highlights the screen or screens that are presenting views or images of the theme. Thereafter, the game can add images to previously empty or non-image displaying screens.

The event or theme of the bonus round preferably relates to a topic that provides entertainment and enjoyment to the player. The event or theme is also preferably recognizable by many people so that the present invention can entertain a large percentage of the players. At some point, in accordance with the event or theme of the bonus round, the game provides an award to the player in such a way that is exciting to the player. The game can employ one or more of the screens in awarding the player, in which one or more screens preferably displays the award, and wherein the other screens present images celebrating the award.

It is therefore an object of the present invention to provide a gaming device with a bonus round that provides players with one or more opportunities to receive awards and display the awards in a manner that provides entertainment and enjoyment to the player.

Another object of the present invention is to display an event or theme while displaying a bonus award, with which the player is familiar, and which provides entertainment and enjoyment to the player.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 5 is a chart containing a non-inclusive list of combinations of views, times and screens of the present invention;

DETAILED DESCRIPTION OF THE INVENTION

Gaming Device and Electronics

Figure 1:
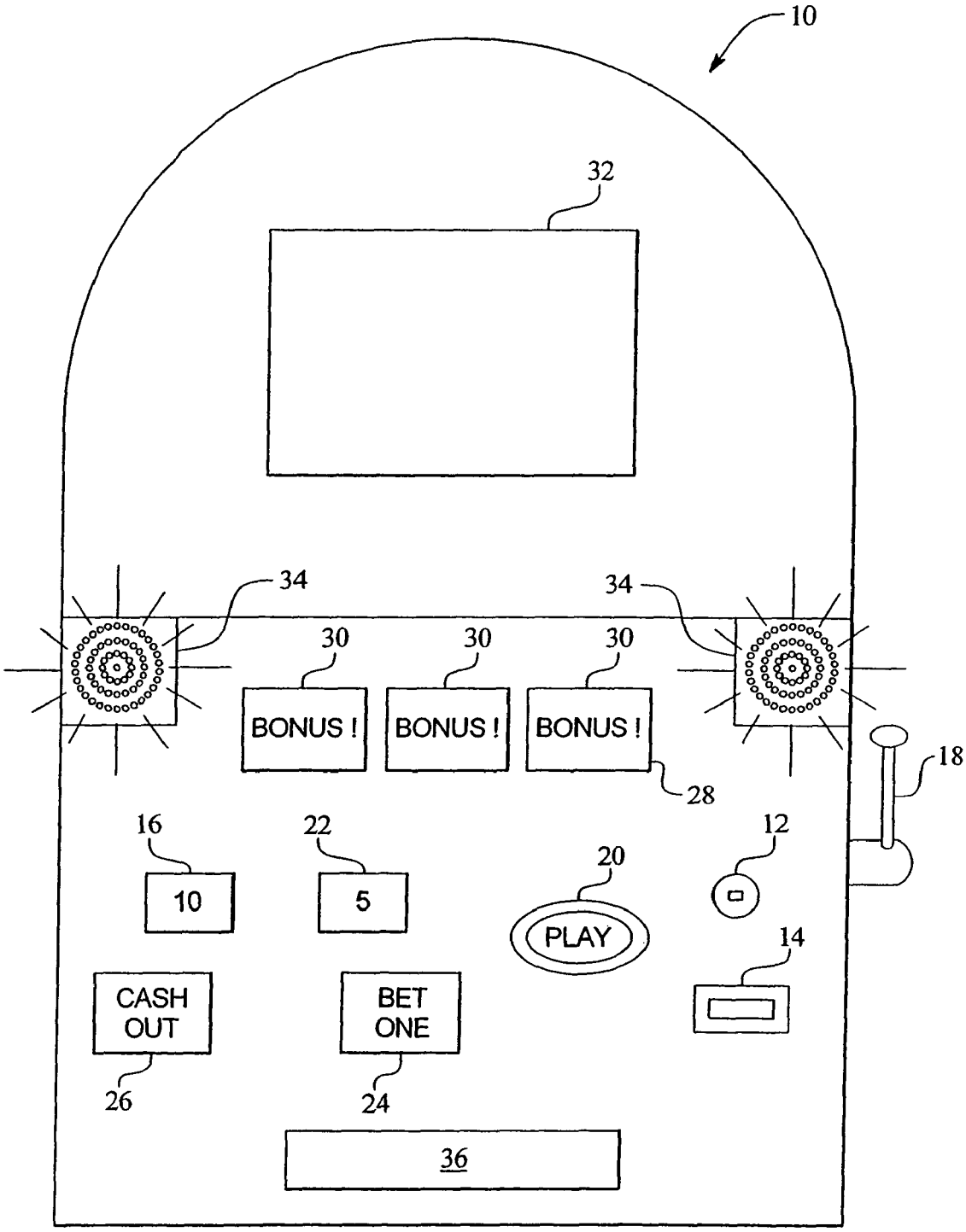
FIG. 1 is a front plan view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) that a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform. Gaming device 10 can incorporate any game such as slot, poker or keno. The symbols used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. The present invention preferably employs or uses credits, however, the present invention is not limited to the use of credits and contemplates employing other units of value such as money. For purposes of describing and claiming this invention, the term "credit" includes any unit of value such as a gaming device credit or actual money.

After depositing the appropriate amount of money, a player can begin the game by pulling arm 18 or by pushing play button 20. Play button 20 can be any play activator used by the player which starts any game or sequence of events in the gaming device.

Referring to FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a paystop display 28 which contains a plurality of reels 30, preferably three to five reels in mechanical or video form. Each reel 30 displays a plurality of symbols such as bells, hearts, martinis, fruits, cactuses, numbers, cigars, letters, bars or other images, which preferably correspond to a theme associated with the gaming device 10. If the reels 30 are in video form, the gaming device 10 preferably displays the video reels 30 in a video monitor described below. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards that keep track of the player's credits.

With respect to electronics, the controller of gaming device 10 preferably includes the electronic configuration generally illustrated in FIG. 2, which has: a processor 38; a memory device 40 for storing program code or other data; a video monitor 32 (i.e., a liquid crystal display) described in detail below; a plurality of speakers 34; and at least one input device as indicated by block 33. The processor 38 is preferably a microprocessor or microcontroller-based platform that is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code, which controls the gaming device 10 so that it plays a particular game in accordance with applicable game rules and pay tables.

Figure 2:
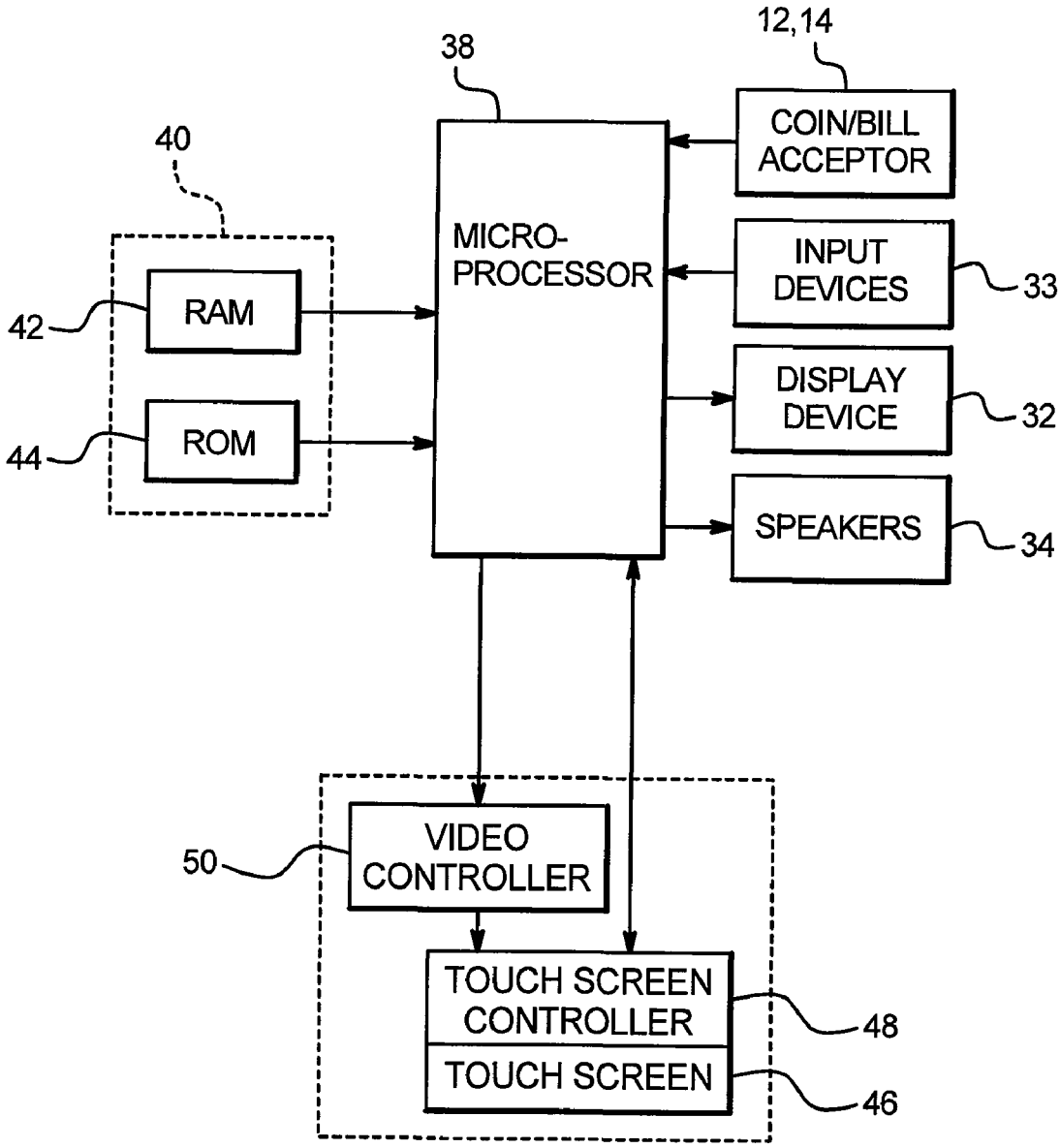
FIG. 2 is a schematic block diagram of the electronic configuration of one embodiment of the gaming device of the present invention.

As illustrated in FIGS. 1 and 2, the player preferably uses the input devices 33, such as the arm 18, play button 20, the bet one button 24 and the cash out button 26 to input signals into gaming device 10. In certain instances, a touch screen 46 and an associated touch screen controller 48 can be used in conjunction with a video monitor described in detail below. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, gaming device 10 also preferably gives players the opportunity to win credits in a bonus round. This type of gaming device 10 will include a program that will automatically begin a bonus round when the player has achieved a qualifying condition in the game. This qualifying condition can be a particular arrangement of indicia on the display window 28. The gaming device 10 also includes a display device such as a display device 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Apparatus of the Invention

Figure 3:
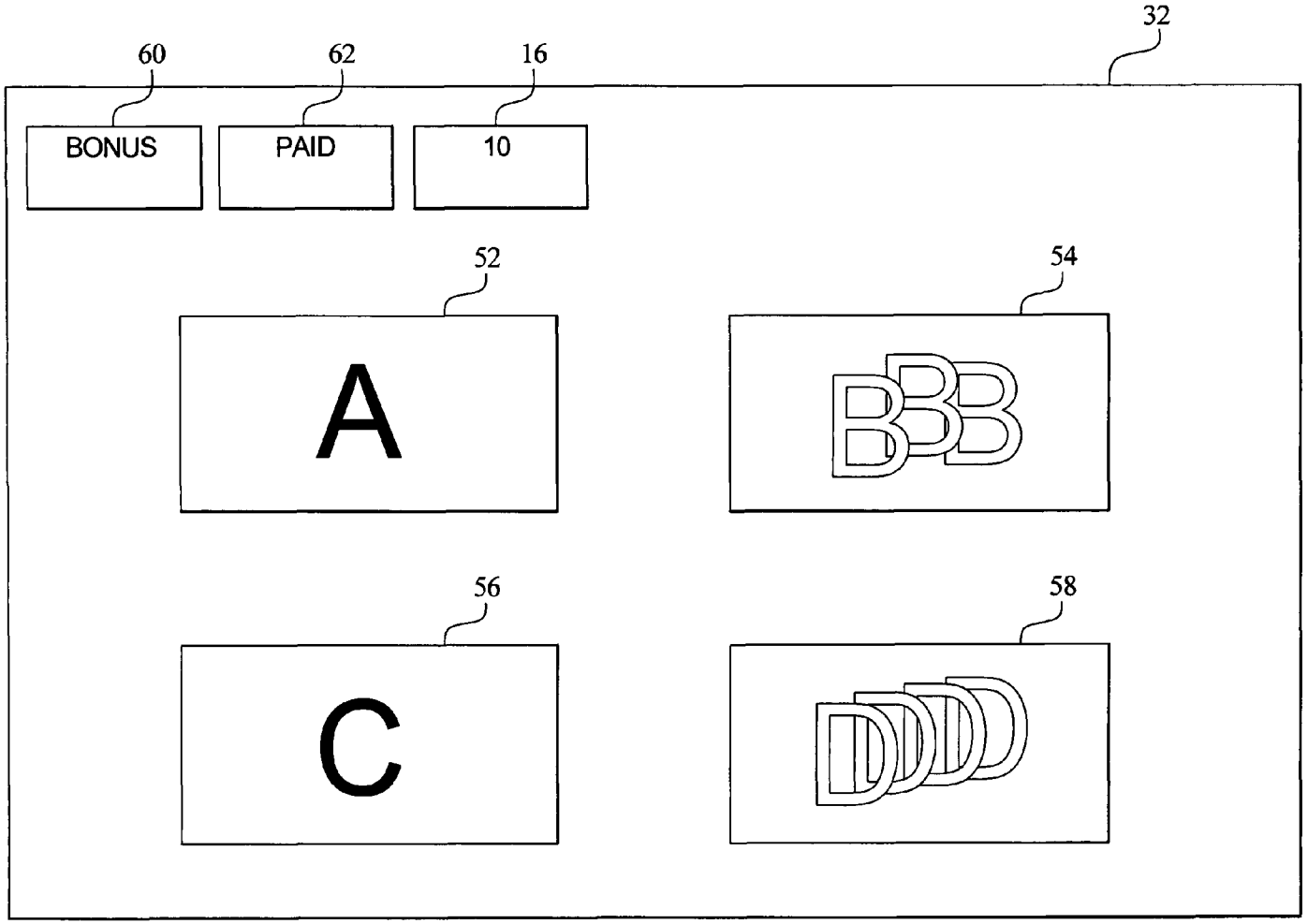
FIG. 3 is an enlarged front plan view of the display device of the present invention having a plurality of screens displayed at once.

Referring now to FIG. 3, a general embodiment of the present invention is shown wherein the display device 32 contains a plurality of screens 52, 54, 56 and 58. The present invention can employ any number of screens and preferably provides four screens. The display device 32 can have a different number of screens at different points in the bonus round. The display device can also contain other indicators such as a bonus indicator 60 that displays a number of credits or awards amassed during the round, a paid indicator 62 that displays a number of bonus round credits paid to the player, and the credit meter 16 described above. If the display device 32 also contains a touch screen 46, then the display device can also contain suitable input devices 33 to enable the player to input decisions into the controller.

The display device 32 simultaneously displays the separate screens 52, 54, 56 and 58. Each screen can display separate and different images from any other screen or have the same image as one or more of the other screens. Each screen can display different types of images. A screen can contain a static image, wherein the screen displays the same image for an extended period of time. The static images can contain an animated image, computer generated image or a picture. A screen can alternatively contain a moving or changing image, wherein the screen displays the images moving over time. The moving images can likewise contain a plurality of animated or computer generated images or a plurality of pictures. It should be appreciated that the video monitor can display an actual video, motion picture or a digitized or computer generated image.

The display device 32 can contain different screens, such as the screens 52 through 58, wherein different screens have static, dynamic, animated, computer generated or picture images. For example, in the display device 32 of FIG. 3, the screen 52 can display the "A" as a static, (i.e., unchanging over time), animated or computer generated image. At the same time, the screen 54 can display the "B" as a moving, animated or computer generated image. At the same time, the screen 56 can display the "C" as a static picture. At the same time, the screen 58 can display the "D" as a moving or motion picture, i.e., a video or movie. Display device 32 can contain any combination of static, dynamic, animated, computer generated and picture screens.

Figure 4B:
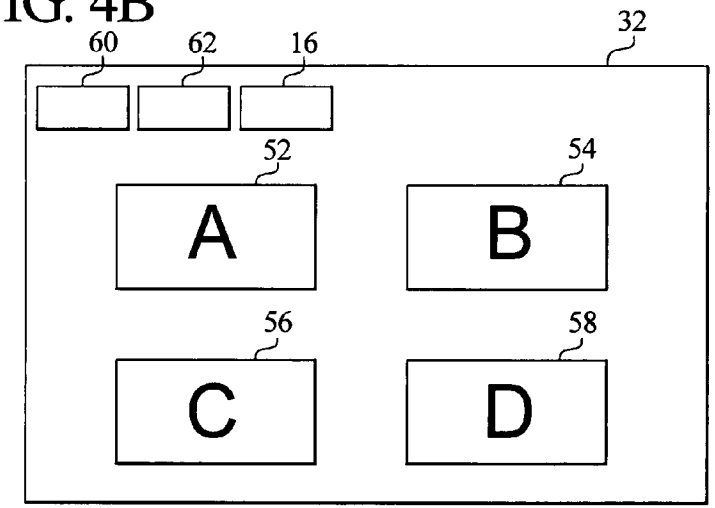
FIG. 4B is a front plan view of the display device of the present invention illustrating a second set of screens in a sequence of sets.
Figure 4D:
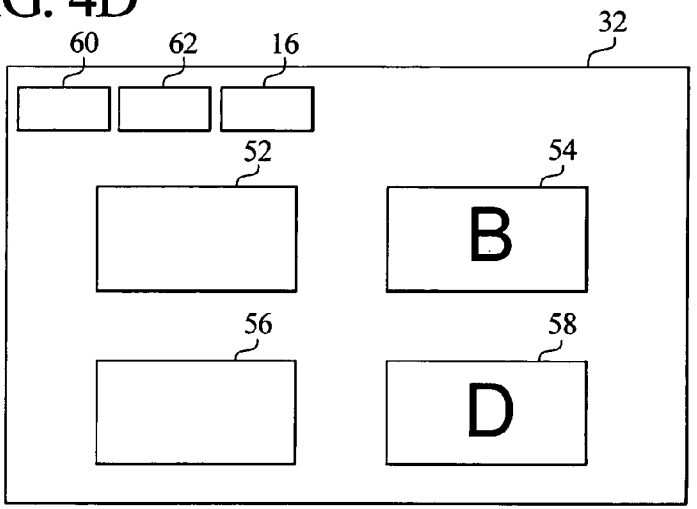
FIG. 4D is a front plan view of the display device of the present invention illustrating a fourth set of screens in a sequence of sets.
Figure 4A:
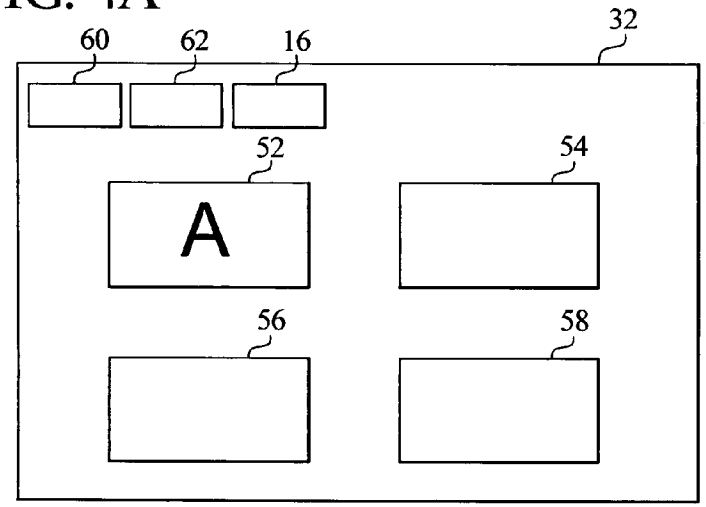
FIG. 4A is a front plan view of the display device of the present invention illustrating one set of screens in a sequence of sets.
Figure 4C:
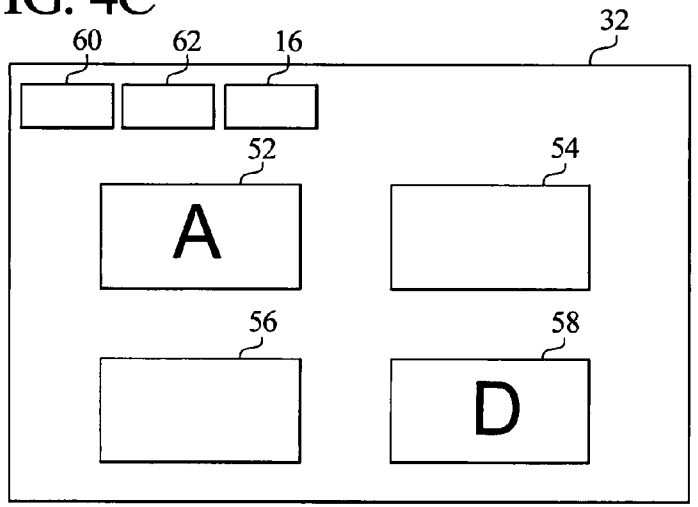
FIG. 4C is a front plan view of the display device of the present invention illustrating a third set of screens in a sequence of sets.

Referring to FIGS. 4A through 4D, the display device 32 is shown illustrating the game's ability to sequence images in the screens. In FIG. 4A, the display device 32 contains the screens 52, 54, 56 and 58. Screen 52 displays the "A" image, while the remainder of the screens 54, 56 and 58 display blank images. At a later time in FIG. 4B, the display device 32 contains the same screens 52 though 58, which display the "A", "B", "C" and "D" images, respectively. At a later time in FIG. 4C, the display device 32 still contains the screens 52 through 58, in which the screen 52 displays the "A" image and the screen 58 displays the "D" image. At a final time in FIG. 4D, the display device 32 again contains the screens 52 through 58, in which the screen 54 displays the "B" image and the screen 58 displays the "D" image. The screens displaying no indicia (i.e., displaying none of "A", "B", "C" or "D") can have no image, i.e., no projection by the display device 32 or a blank image, i.e., a projection of a single color or pattern.

The screens preferably display images that make up or comprise an event or theme. The event or theme can be any event or theme that the implementor of the bonus round desires. The event or theme is preferably well known so that many people can play and enjoy the bonus round. The event or theme also preferably brings excitement and enjoyment in real life so that the event or theme also brings excitement and enjoyment in the bonus round. The events or themes are not limited to but can be, for example, holidays, a birthday, an adventure or a trip.

The present invention preferably presents the player with an award and displays the award in conjunction with the event or theme of the bonus round so that the receipt of the award provides excitement and enjoyment to the player. The game can show the player a number of possible awards before selecting an award, i.e., show the player that the game is "thinking of" or "contemplating" the player's award. Alternatively, the game can make the player play bonus game to receive an award or the game can merely present the player with an award. The awards can be a number of base game credits or a multiplier that multiplies some value, such as a base game award or an amount of base game credits that the player has bet.

The present invention preferably provides audio productions in the form of voice, sound effects or music to accompany the displays of the different screens. The audio productions can appear to accompany one of the individual screens, e.g., the speakers 34 of the gaming device 10 emit the sound of a voice, while one of the screens displays a person talking. Alternatively, the audio productions can appear to accompany each of the screen displays, e.g., the speakers 34 of the gaming device 10 emit music that does not distinguish any one of the displays.

The screens display different views or images that make up or comprise the event or theme. Since the display device preferably contains more than one screen, the implementor of the bonus round can employ the multiple screens in a plurality of ways that present the theme in an entertaining and exciting manner. The game can display images sequentially as the event unfolds in one screen. The game can also display images sequentially as the events unfold in multiple screens. Employing multiple screens enables the game to present different views of the event occurring at the same time of the event. Employing multiple screens also enables the game to present views of the event that have occurred at different times during the event.

Referring now to FIG. 5, a chart 64 is shown having the seven combinations 66 through 78, each of which vary from the others in terms of the views and times of the event displayed and the number of screens employed. The chart 64 shows the variations of the present invention, i.e., the combinations that the present invention can employ. The chart 64 is illustrative and does not limit the present invention to the combinations discussed. The present invention can employ a plurality of the combinations discussed in detail below, at one time, in different screens of the display device 32 and thus is not limited to only displaying one of the combinations discussed below.

Figure 6:
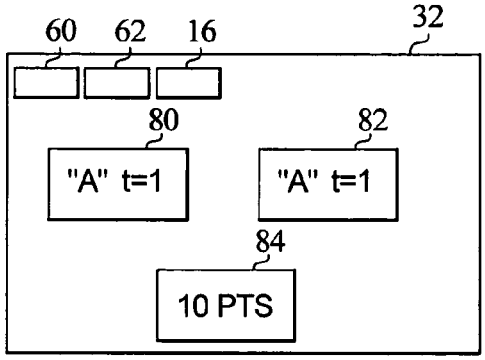
FIG. 6 is a front plan view of the display device illustrating one combination of views, times and screens of the present invention.

Referring to the combination 66 of FIG. 5, the present invention can display the same view or image of the same time of an event in a plurality of screens. Referring to FIG. 6, an example of the combination 66 is displayed, wherein an image or view of the letter "A" at the time t=1, is shown in screens 80 and 82, i.e., a plurality of screens. The present invention can employ the combination 66, for example, to highlight an image or view in a single screen not displaying the letter "A". For example, while the screens 80 and 82 each display the letter "A", the screen 84 displays and highlights an award.

Figure 7:
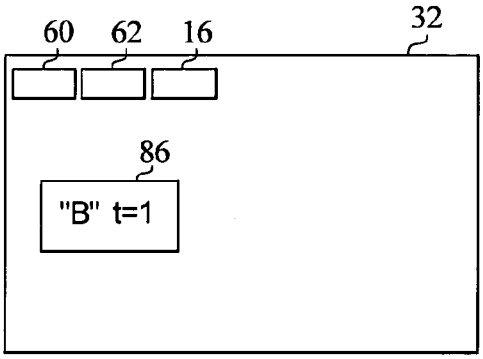
FIGS. 7 and 8 are front plan views of the display device illustrating a second combination of views, times and screens of the present invention.
Figure 8:
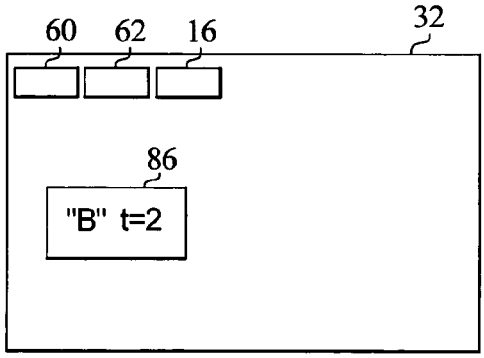

Referring to the combination 68 of FIG. 5, the present invention can display the same view or image at different times of an event in a single screen. Referring to FIGS. 7 and 8, an example of the combination 68 is displayed, wherein an image or view of the letter "B" at the time t=1 is shown in the screen 86 of FIG. 7, while an image or view of the letter "B" at the time t=2 is shown in the same screen 86 of FIG. 8. The combination 68 covers a single video view or image, such as a security camera that is shown on one screen in real, sped-up, or slowed time.

Figure 9:
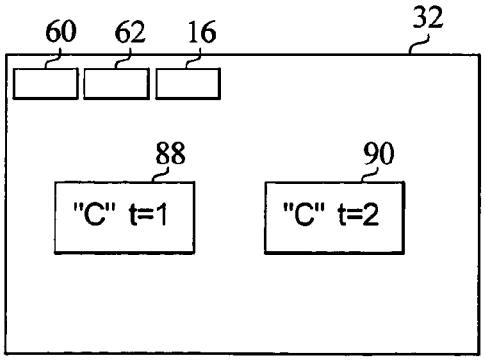
FIG. 9 is a front plan view of the display device illustrating a third combination of views, times and screens of the present invention.

Referring to the combination 70 of FIG. 5, the present invention can display the same view or image at different times of an event in different screens. Referring to FIG. 9, an example of the combination 70 is displayed, wherein an image or view of the letter "C" at the time t=1 is shown in the screen 88, while an image or view of the letter "C" at the time t=2 is shown in a different screen 90. The combination 70 covers a static or dynamic delay of the same view or image.

Figure 10:
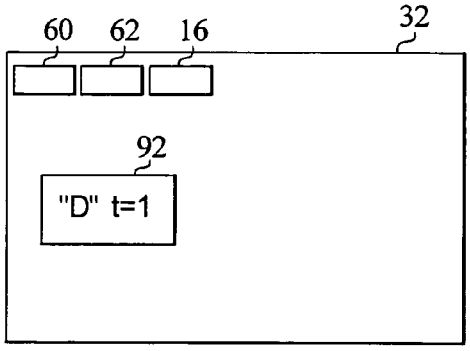
FIGS. 10 and 11 are front plan views of the display device illustrating a fourth combination of views, times and screens of the present invention.
Figure 11:
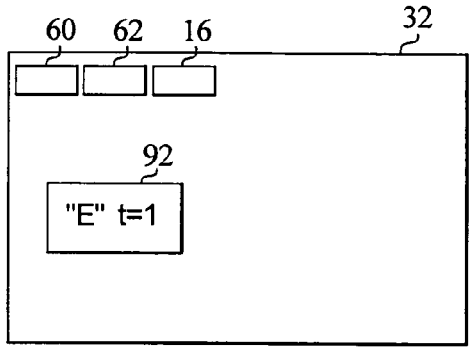

Referring to the combination 72 of FIG. 5, the present invention can display different views or images of the same time of an event in a single screen. Referring to FIGS. 10 and 11, an example of the combination 72 is displayed, wherein an image or view of the letter "D" at the time t=1 is shown in the screen 92 of FIG. 10, while an image of the letter "E" at the time t=1 is shown in the screen 92 of FIG. 11. The combination 72 covers a situation such as consecutively displaying two different photographs taken of the same person at the same time in a single screen.

Figure 12:
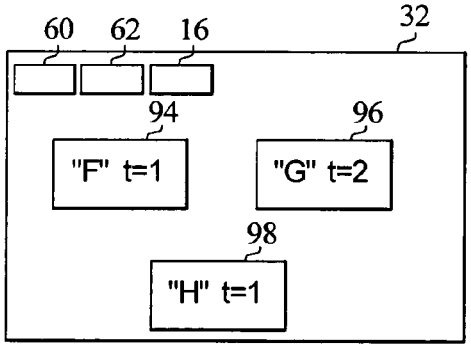
FIG. 12 is a front plan view of the display device illustrating a fifth combination of views, times and screens of the present invention.

Referring to the combination 74 of FIG. 5, the present invention can display different views or images of the same time of an event in different screens. Referring to FIG. 12, an example of the combination 74 is displayed, wherein an image or view of the letter "F" at the time t=1 is shown in the screen 94, an image or view of the letter "G" at the time t=1 is shown in the screen 96 and an image or view of the letter "H" at the time t=1 is shown in the screen 98. The combination 74 covers multiple static or dynamic displays of the same time, step or stage of an event, e.g. displaying multiple security camera images as the cameras film the same area (event) of a room.

Figure 13:
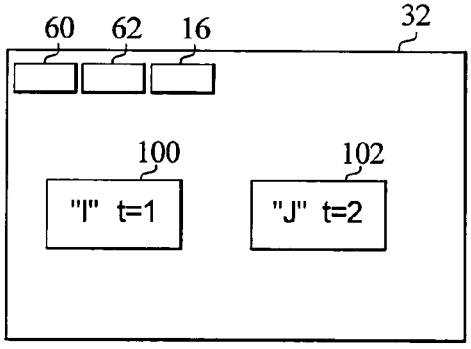
FIG. 13 is a front plan view of the display device illustrating a sixth combination of views, times and screens of the present invention.

Referring to the combination 76 of FIG. 5, the present invention can display different views or images of different times of an event in different screens. Referring to FIG. 13, an example of the combination 76 is displayed, wherein an image or view of the letter "I" at the time t=1 is shown in the screen 100 and an image or view of the letter "J" at the time t=2 is shown in the screen 102. The combination 76 covers a situation such as a scrapbook having different pictures or views taken at different times of an event, which are displayed on a single page or screen.

Figure 14:
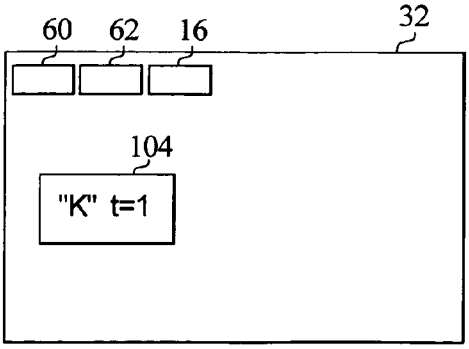
FIGS. 14 and 15 are front plan views of the display device illustrating a seventh combination of views, times and screens of the present invention.
Figure 15:
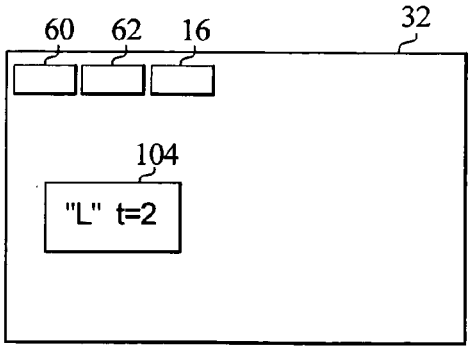

Referring to the combination 78 of FIG. 5, the present invention can display different views or images of different times of an event in a single screen. Referring to FIGS. 14 and 15, an example of the combination 78 is displayed, wherein an image or view of the letter "K" at the time t=1 is shown in the screen 104 of FIG. 14, while an image of the letter "L" at the time t=2 is shown in the screen 104 of FIG. 15. The combination 78 covers a situation such as a movie or motion picture occurring on one screen, wherein the single screen displays multiple views or images that jump backward or forward along the timeline of an event or story.

FIGS. 16 through 21 illustrate one embodiment having many of the features and aspects of the present invention described above. The different screens of the different displays portray an event or theme, which is the well known New Year's Eve countdown celebration in New York City's Time Square. The event is hosted by a popular and well-known television personality. The different screens comprise television sets and create the impression of a television station's editing room, wherein the station has many cameras positioned at different large cities in the United States. The editing room of the television station receives and displays each of the signals that it is filming.

Figure 16:
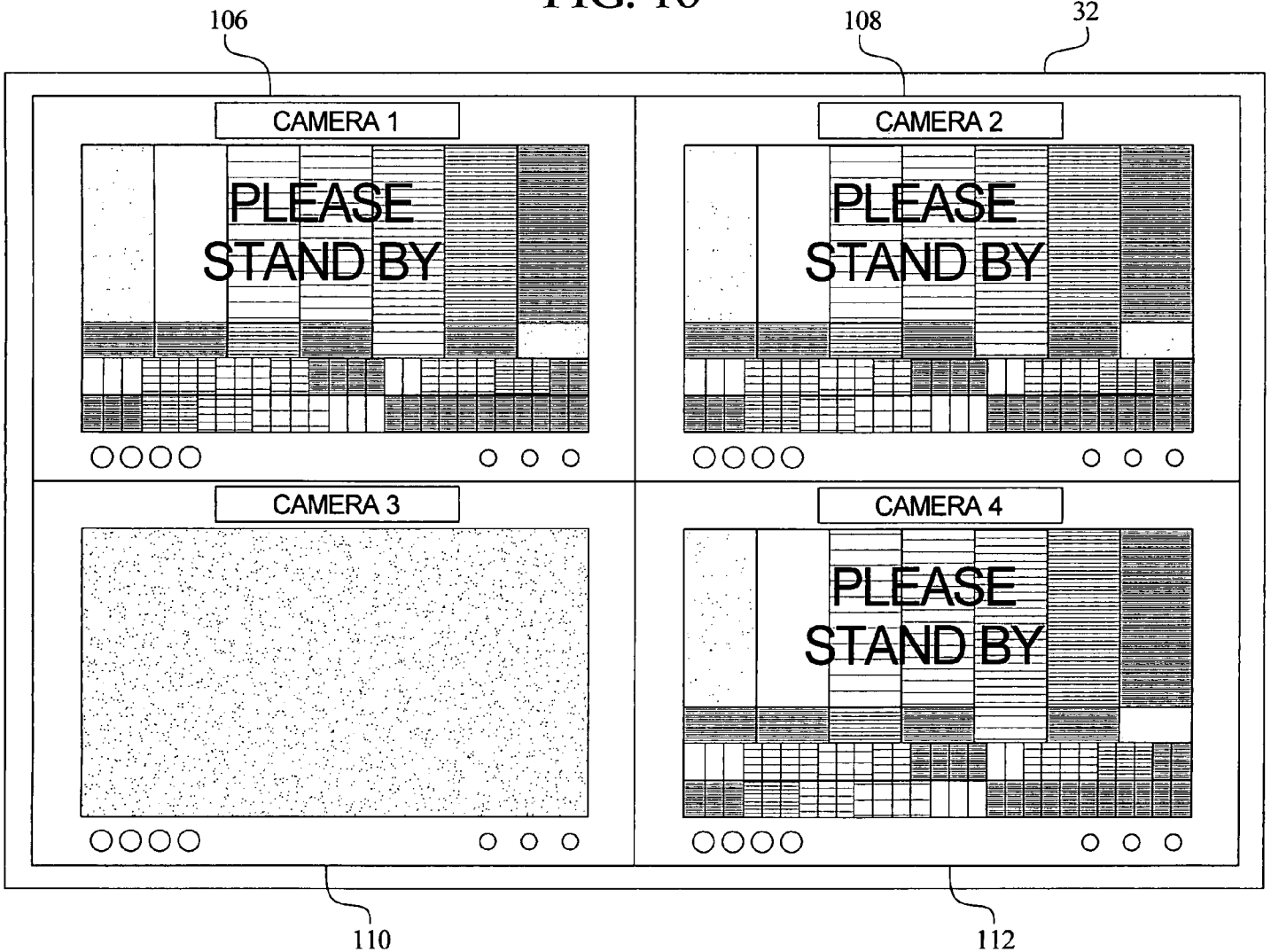
FIG. 16 is a front plan view of the display device illustrating a first set of screens of one embodiment of the present invention.

Referring to FIG. 16, one screenshot of the display device 32 is shown containing four screens 106, 108, 110 and 112. Screens 106, 108 and 112 illustrate the combination 66 of FIG. 5, wherein different screens contain the same view, i.e., the "Please Stand By" indicia and test pattern backgound, of the same time of the event, i.e., before the countdown begins. All four screens illustrate the combination 74 of FIG. 5, wherein different screens display different views of the same time of the event. All four screens are computer generated images programmed into the controller of the gaming device.

Figure 17:
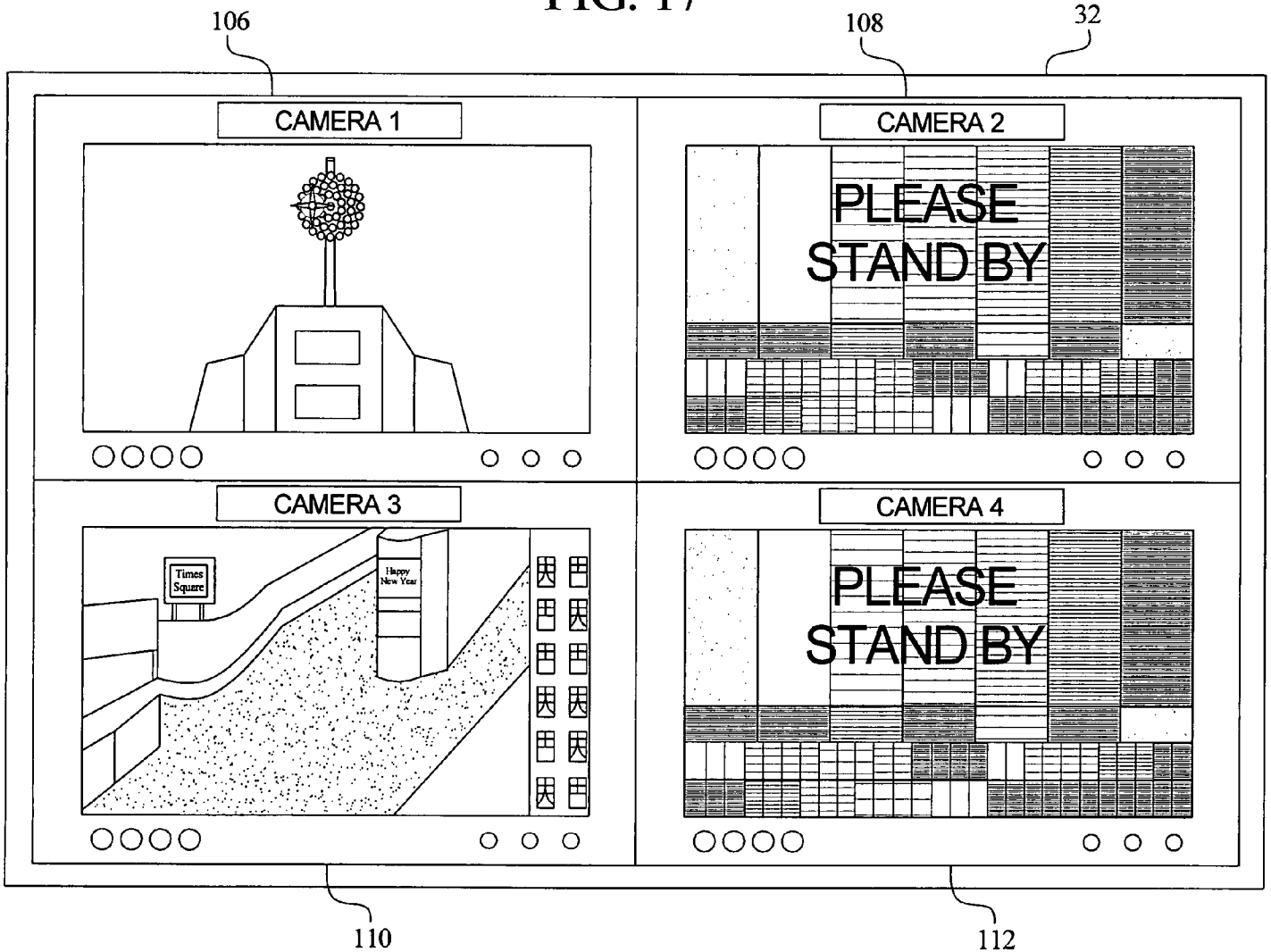
FIG. 17 is a front plan view of the display device illustrating a second set of screens of one embodiment of the present invention.

Referring to FIG. 17, a second screenshot of the display device 32 is shown, wherein the game has changed the view of screen 106 to a video of the New Year's Eve Ball and the view of screen 110 to a video clip of Times Square, wherein thousands of people wait to usher in the New Year. FIG. 17 illustrates the combination 74 wherein the different screens display different views of the same time in the event. That is, the screen 106 shows the Ball as the people in Times Square in screen 110 are viewing it.

Figure 18:
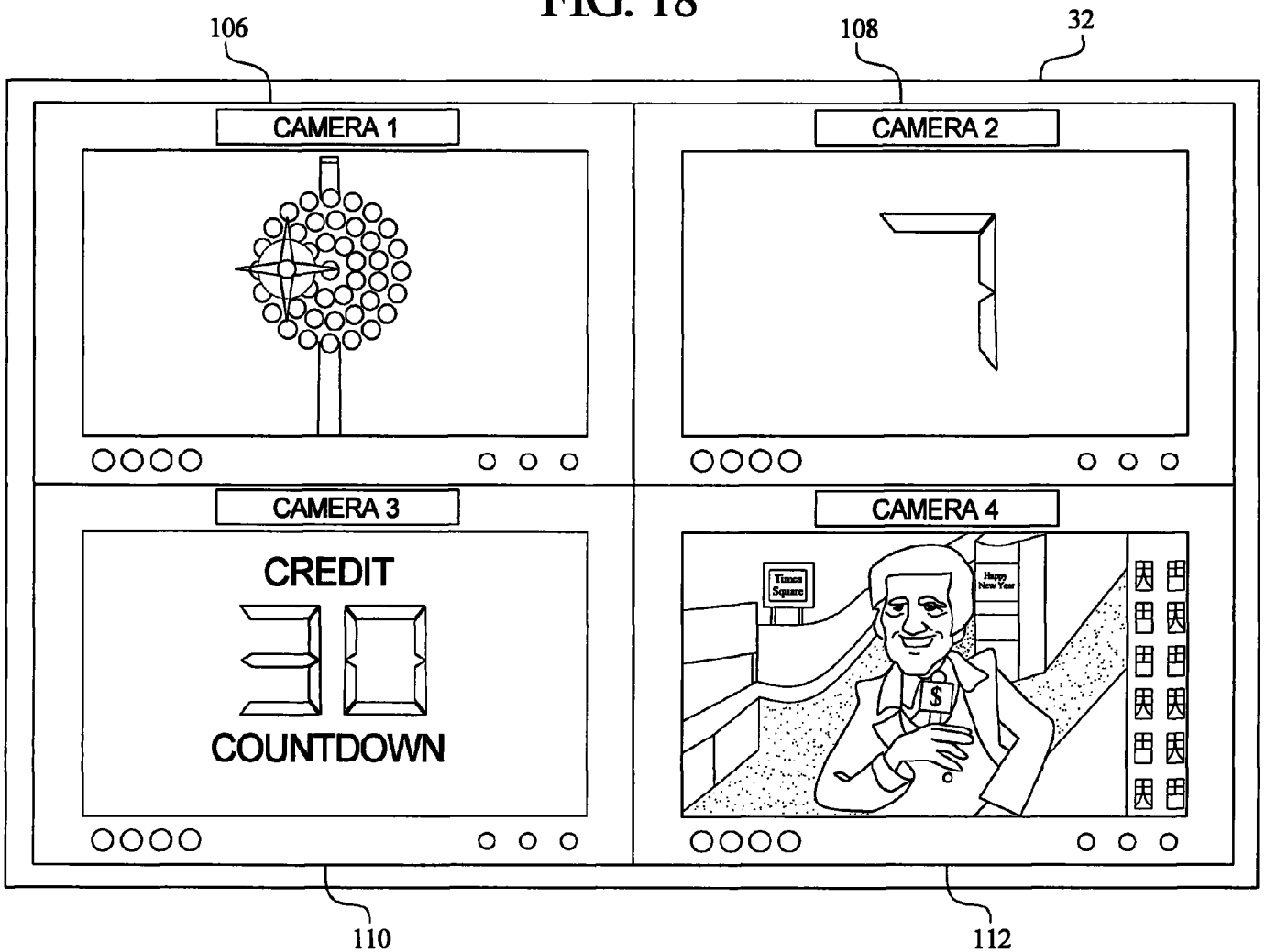
FIG. 18 is a front plan view of the display device illustrating a third set of screens of one embodiment of the present invention.

Referring to FIG. 18, a third screenshot of the display device 32 is shown, wherein the game has changed the view of all four screens in the bonus round and awards bonus credits in accordance with the theme. The game still maintains simultaneous views (employing the combination 74 in the display of FIG. 17), wherein each screen displays the same time of the event. The screen 112 displays a celebrity and the speakers emit his voice saying, "Hey, the excitement is rising here in Times Square. The ball is about to drop, the New Year's on it's way in just a few seconds from now. Keep your eye on the ball. Here we go with . . . " At this point in time Screen 108 begins to count down 10-9-8-7-6-5-4-3-2-1 as the ball in screen 106 sparkles (indicating that it is moving or dropping) and as the screen 110 randomly generates and displays possible awards. FIG. 18 contains two computer generated screens and two video clips.

Figure 19:
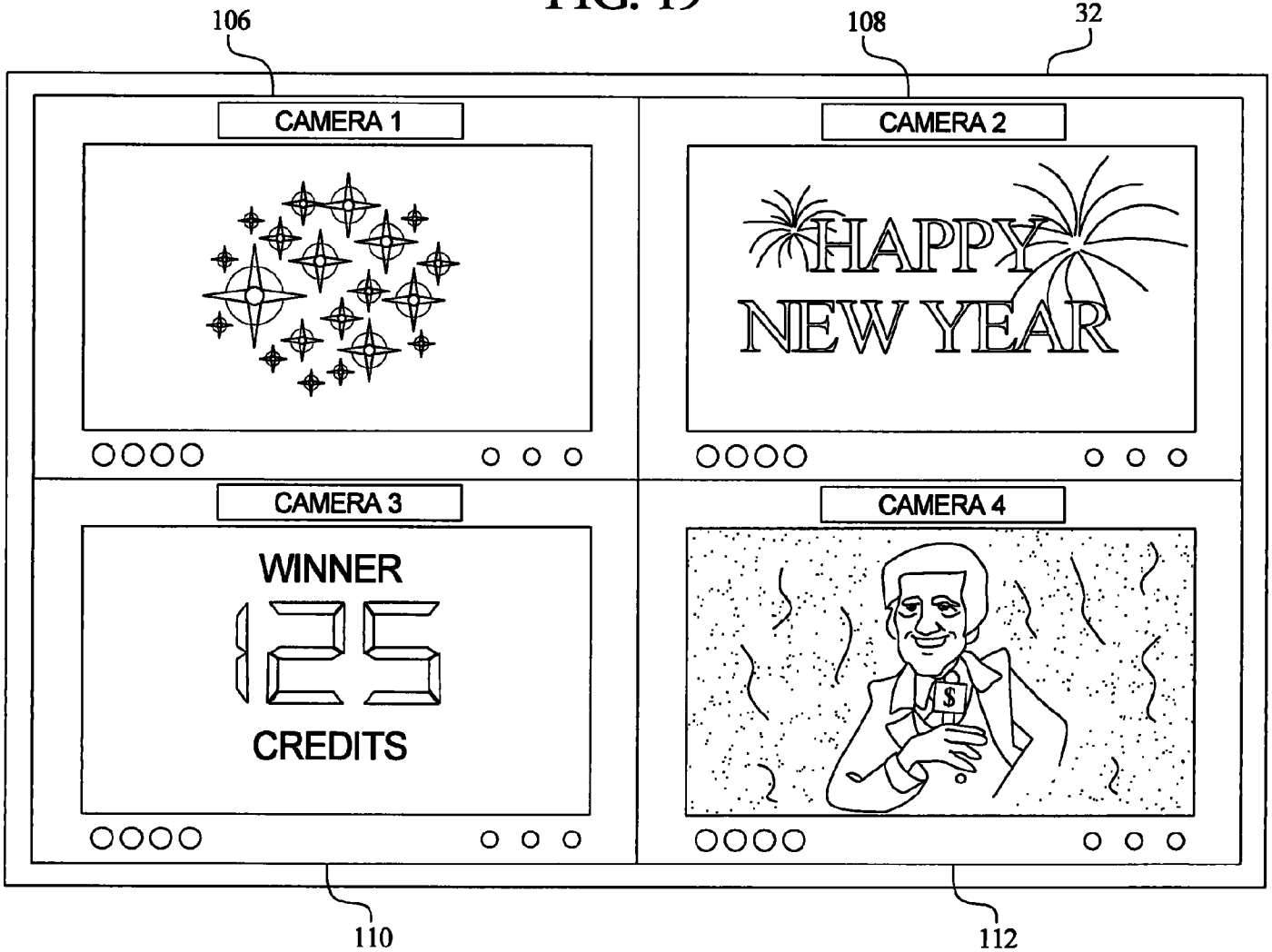
FIG. 19 is a front plan view of the display device illustrating a fourth set of screens of one embodiment of the present invention.

FIG. 19 displays the player's award, which is the randomly generated and displayed value as the countdown reaches zero. The present invention contemplates any suitable method of generating and displaying the award, which preferably coincides or accompanies the event or theme as illustrated here. FIG. 19 illustrates an example of the combination 76, wherein different screens display different views of different times in the event. Screens 106, 108 and 110 have frozen and show a frozen glitter pattern in screen 106, the "Happy New Year" indicia in screen 108 and the winning credits in screen 110 as of the second that the New Year began. Screen 112 continues to rap up the event and advance time, wherein the celebrity says, "Hey, it's been a great time here. Thanks for joining us. We'll see you the next time. For now, good night."

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention claimed is:

1. A gaming device comprising:

at least one input device;

at least one display device;

at least one processor; and at least one memory device which stores a plurality of instructions, which when executed by the at least one processor, causes the at least one processor to operate with the at least one input device and the at least one display device for a play of the wagering game, to:

accept a wager from a player to begin the play of the wagering game, and upon an occurrence of a triggering event in association with the wagering game:

(a) cause a time countdown indicator to display a changing count of units of real time from a first predetermined number representing a first predetermined time to a second different predetermined number representing a second different predetermined time, (b) randomly generate a first award amount, (c) randomly generate a second different award amount which is providable to the player, (d) cause an award indicator to display the randomly generated first award amount changing to the randomly generated second different award amount during the display of the time countdown indicator counting from the first predetermined number to the second different predetermined number, such that the randomly generated second different award amount is displayed simultaneously or substantially simultaneously with a display of the second different predetermined number, wherein the first award amount and the second award amount are independent of the time countdown indicator, and (e) cause the randomly generated second different award amount to be provided to the player.

2. The gaming device of claim 1, wherein the processor is programmed to operate with the award indicator to cause the award indicator to display the first award amount changing to at least one other award amount before changing to the randomly generated second different award amount.

3. The gaming device of claim 2, wherein the processor is programmed to operate with the time countdown indicator to cause the time countdown indicator to display the changing count of units of real time from the first predetermined number to at least one intermediate number representing an intermediate time between the first predetermined number and the second different predetermined number before displaying the second different predetermined number.

4. The gaming device of claim 2, wherein at least three of the award amounts are different.

5. The gaming device of claim 1, wherein the processor is programmed to operate with the time countdown indicator to cause the time countdown indicator to display the changing count of units of real time from the first predetermined number to at least one intermediate number representing an intermediate time between the first predetermined number and the second different predetermined number before displaying the second different predetermined number.

6. The gaming device of claim 5, wherein at least three of the numbers are different.

7. The gaming device of claim 1, wherein the second different predetermined number remains unchanged for every occurrence of the triggering event.

8. The gaming device of claim 1, wherein the time countdown indicator and the award indicator are part of a single display device.

9. A gaming device comprising:

at least one input device;

at least one display device;

at least one processor; and at least one memory device which stores a plurality of instructions, which when executed by the at least one processor, causes the at least one processor to operate with the at least one input device and the at least one display device, for a play of a wagering game, to:

accept a wager from a player to begin the play of the wagering game, and upon an occurrence of a triggering event in association with the wagering game:

(a) substantially simultaneously cause a time indicator to display a first predetermined time and cause the award indicator to display a generated first award amount, said first award amount being greater than zero, (b) randomly generate a second award amount providable to the player, (c) substantially simultaneously cause the time indicator to display a changing count of units of real time from the first predetermined time to a second different predetermined time and cause an award indicator to display a change from the first award amount to the randomly generated second different award amount, such that the randomly generated second different award amount is displayed simultaneously or substantially simultaneously with a display of the second different predetermined time wherein the first award amount and the second award amount are independent of the time indicator, and (d) provide the randomly generated second different award amount to the player.

10. The gaming device of claim 9, wherein the second different predetermined time remains unchanged for every occurrence of the triggering event.

11. The gaming device of claim 9, wherein the processor is programmed to operate with the award indicator to cause the award indicator to display the first award amount changing to at least one intermediate award amount before changing to the randomly generated second different award amount.

12. The gaming device of claim 11, wherein the first award amount and the intermediate award amount are different.

13. The gaming device of claim 11, wherein the processor is programmed to operate with the time indicator to cause the time indicator to display the first predetermined time changing to at least one intermediate time between the first predetermined time and the second different predetermined time before displaying the second different predetermined time.

14. The gaming device of claim 13, wherein at least three of the award amounts are different.

15. The gaming device of claim 9, wherein the processor is programmed to operate with the time indicator to cause the time indicator to display the first predetermined time changing to at least one intermediate time between the first predetermined time and the second different predetermined time before displaying the second different predetermined time.

16. The gaming device of claim 9, wherein the first predetermined time is greater than the second different predetermined time.

17. The gaming device of claim 9, wherein the time indicator and the award indicator are part of a single display device.

18. A gaming device comprising:

at least one input device;

at least one display device;

at least one processor;

at least one memory device which stores a plurality of instructions, which when executed by the at least one processor, causes the at least one processor to operate with the at least one input device, and the at least one display device, for a play of a wagering game, to:

(a) begin the play of the wagering game, the wagering game including a base game operable upon a wager by a player and a bonus game operable upon an occurrence of a triggering event associated with the base game;

(b) cause a time indicator to display a changing count of units of real time from a first predetermined number representing a first predetermined time to at least one intermediate number representing an intermediate time and then to a last predetermined number representing a last predetermined time, (c) cause a first award amount to be generated, (d) cause an at least one intermediate award amount to be generated, (e) cause a last different award amount to be generated, the last different award amount providable to the player, (f) substantially simultaneously cause an award indicator to display the first award amount changing to the at least one intermediate award amount and then to the randomly generated last different award amount, such that the last different award amount is displayed simultaneously or substantially simultaneously with a display of the last predetermined number wherein the first award amount, the at least one intermediate award amount, and the last award amount are independent of the time indicator, and (g) provide the randomly generated last different award amount to the player.

19. The gaming device of claim 18, wherein at least three of the award amounts are different.

20. The gaming device of claim 18, wherein the first predetermined number is greater than the last predetermined number.

21. A method of controlling a gaming device, said method comprising:

(a) operating a wagering game upon a wager by a player, said wagering game including a triggering event; and (b) after an occurrence of the triggering event, causing:

(i) a time countdown indicator to display a changing count of units of real time from a first predetermined number representing a first predetermined time to a second different predetermined number representing a second different predetermined time, (ii) determining a first award amount, (iii) randomly generating a second award amount providable to the player, (iv) an award indicator to display the first award amount changing to the randomly generated second different award amount during the display of the time countdown indicator counting from the first predetermined number to the second different predetermined number, such that the randomly generated second different award amount is displayed simultaneously or substantially simultaneously with a display of the second different predetermined number wherein the first award amount and the second award amount are independent of the time countdown indicator, and (v) the randomly generated second different award amount to be provided to the player.

22. The method of claim 21, which includes causing the award indicator to display the first award amount changing to at least one intermediate award amount before changing to the randomly generated second different award amount.

23. The method of claim 22, which includes causing the time countdown indicator to display the changing count of units of real time from the first predetermined number to at least one intermediate number representing an intermediate time between the first predetermined number and the second different predetermined number before displaying the second different predetermined number.

24. The method of claim 22, wherein at least three of the award amounts are different.

25. The method of claim 21, which includes causing the time countdown indicator to display the changing count of units of real time from the first predetermined number to at least one intermediate number representing an intermediate time between the first predetermined number and the second different predetermined number before displaying the second different predetermined number.

26. The method of claim 25, wherein at least three of the numbers are different.

27. The method of claim 21, wherein the second different predetermined number remains unchanged for every occurrence of the triggering event.

28. The method of claim 21, wherein the time countdown indicator and the award indicator are part of a single display device.

29. The method of claim 21, wherein the gaming device is operated through a data network.

30. The method of claim 29, wherein the data network is an internet.

31. A method of operating a gaming device, said method comprising:

(a) operating a game upon a wager by a player, said game including a triggering event; and (b) after an occurrence of the triggering event, (i) substantially simultaneously causing a time indicator to display a first predetermined time and causing an award indicator to display a first award amount, said first award amount greater than zero, (ii) randomly generating a second award amount providable to the player, (iii) thereafter substantially simultaneously causing the time indicator to display a changing count of units of real time from the first predetermined time to a second different predetermined time and the award indicator to display a change from the first award amount to the randomly generated second different award amount, such that the randomly generated second different award amount is displayed simultaneously or substantially simultaneously with a display of the second different predetermined time wherein the first award amount and the second award amount are independent of the time indicator, and (iv) providing the randomly generated second different award amount to the player.

32. The method of claim 31, wherein the second different predetermined time remains unchanged for every occurrence of the triggering event.

33. The method of claim 31, which includes causing the award indicator to display the first award amount changing to at least one intermediate award amount before changing to the randomly generated second different award amount.

34. The method of claim 33, wherein the first award amount and the intermediate award amount are different.

35. The method of claim 33, which includes causing the time indicator to display the first predetermined time changing to at least one intermediate time between the first predetermined time and the second different predetermined time before displaying the second different predetermined time.

36. The method of claim 35, wherein at least three of the award amounts are different.

37. The method of claim 31, which includes causing the time indicator to display the first predetermined time changing to at least one intermediate time between the first predetermined time and the second different predetermined time before displaying the second different predetermined time.

38. The method of claim 31, wherein the first predetermined time is greater than the second different predetermined time.

39. The method of claim 31, wherein the time indicator and the award indicator are part of a single display device.

40. The method of claim 31, wherein the gaming device is operated through a data network.

41. The method of claim 40, wherein the data network is an internet.

42. A method of controlling a gaming device, said method comprising:

(a) operating a base game upon a wager by a player; and (b) operating a bonus game upon an occurrence of a triggering event associated with the base game, which includes:

(i) causing a time indicator to display a changing count of units of real time from a first predetermined number representing a first predetermined time to at least one intermediate number representing an intermediate time and then to a last predetermined number representing a last predetermined time, (ii) determining a first award amount, (iii) determining an at least one intermediate award amount, (iv) randomly generating a last different award amount providable to the player, (v) substantially simultaneously causing an award indicator to display the first award amount changing to the at least one intermediate award amount and then to the randomly generated last different award amount, such that the last different award amount is displayed simultaneously or substantially simultaneously with a display of the last predetermined number wherein the first award amount and the at least one intermediate award amount, and the last different award amount are independent of the time indicator, and (vi) providing the randomly generated last different award amount to the player.

43. The method of claim 42, wherein at least three of the award amounts are different.

44. The method of claim 42, wherein the first predetermined number is greater than the last predetermined number.

45. The method of claim 42, wherein the gaming device is operated through a data network.

46. The method of claim 45, wherein the data network is an internet.

* * * * *

UNITED STATES PATENT AND TRADEMARK OFFICE

CERTIFICATE OF CORRECTION

PATENT NO. : 7,871,324 B2
APPLICATION NO. : 10/899165
DATED : January 18, 2011
INVENTOR(S) : Kaminkow It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1244 days.

Signed and Sealed this
Thirty-first Day of May, 2011

David J. Kappos

David J. Kappos
*Director of the United States Patent and Trademark Office*